US006487831B1

(12) United States Patent
Turra et al.

(10) Patent No.: US 6,487,831 B1
(45) Date of Patent: Dec. 3, 2002

(54) AUTOMATIC MACHINE WITH A CORDLESS CONTROLLED OPERATING WHEEL

(75) Inventors: Mario Turra, Casalecchio Di Reno (IT); Pier Luigi Lolli, Guiglia (IT); Fiorenzo Draghetti, Medicina (IT)

(73) Assignee: G.D Societa' Per Azioni, Bologna (IT)

( * ) Notice: Subject to any disclaimer, the term of this patent is extended or adjusted under 35 U.S.C. 154(b) by 117 days.

(21) Appl. No.: 09/669,046

(22) Filed: Sep. 25, 2000

(30) Foreign Application Priority Data

Sep. 27, 1999 (IT) ..... B099A0517

(51) Int. Cl.[7] ..... B65B 19/28; B65B 11/28
(52) U.S. Cl. ..... 53/52; 53/234
(58) Field of Search ..... 53/234, 52, 55, 53/493, 64, 75, 77

(56) References Cited

U.S. PATENT DOCUMENTS 3,979,881 A 9/1976 Seragnoli
4,926,544 A * 5/1990 Koyanagi et al. ..... 29/703
5,123,226 A 6/1992 Near
5,477,661 A 12/1995 Draghetti et al.
6,105,343 A * 8/2000 Grove et al. ..... 53/317
6,170,228 B1 * 1/2001 Zeman, III ..... 53/168
6,305,148 B1 * 10/2001 Bowden et al. ..... 206/386

FOREIGN PATENT DOCUMENTS

| | | |
|---|---|---|
| EP | 0792803 | 9/1997 |
| EP | 0863078 | 9/1998 |
| GB | 2255954 | 11/1992 |

* cited by examiner

*Primary Examiner*—Stephen F. Gerrity
(74) *Attorney, Agent, or Firm*—Ladas & Parry

(57) ABSTRACT

An automatic machine wherein an operating wheel rotating about a central axis supports a number of work stations, which all communicate with a fixed control unit by means of a single cordless communication unit having a movable communication device carried by the wheel, and a fixed communication device located on the machine; the fixed and movable communication devices are coaxial with the axis of the wheel so as to substantially face each other at all times as the wheel rotates.

12 Claims, 3 Drawing Sheets

AUTOMATIC MACHINE WITH A CORDLESS CONTROLLED OPERATING WHEEL

The present invention relates to an automatic machine with a cordless controlled operating wheel.

The present invention may be used to advantage, among other things, on automatic cigarette manufacturing machines, such as filter assembly machines and packaging machines in general comprising at least one operating wheel having a number of individually controlled work stations.

BACKGROUND OF THE INVENTION

For the sake of simplicity, and purely by way of example, reference is made in the following description to overwrapping machines comprising an operating wheel defined by a heat-seal wheel along which are distributed a number of heat-seal stations.

On known automatic machines for overwrapping packets of cigarettes, e.g. on machines of the type described in Patent Application EP-A-792803, each packet of cigarettes is paired with a respective sheet of plastic heat-seal wrapping material, which is first folded about the packet, and then stabilized by heat sealing to form a tubular wrapping. The open end portions of the tubular wrapping are then folded onto the end walls of the packet, which is fed to a heat-seal wheel on which a respective pair of heat-seal devices engages the end walls of the packet to stabilize the wrapping by heat sealing.

A fairly fast, good-quality heat seal calls for fast, highly accurate temperature control of the heat-seal devices, which, on known automatic machines for overwrapping packets of cigarettes, is performed by a control device carried by the machine in a fixed position off the heat-seal wheel, and which communicates with the heat-seal devices by means of sliding contacts on the heat-seal wheel.

Sliding contacts, however, involve several drawbacks in terms of cost, size and reliability. That is, a heat-seal wheel normally supports from eight to twenty heat-seal devices, each of which requires two signal contacts and two power contacts. Sliding signal contacts are particularly problematic by generating numerous noise signals, and by requiring highly precise mechanical connections and the use of noble materials (gold or silver) to ensure optimum signal transmission and reliability of the contact itself.

SUMMARY OF THE INVENTION

It is an object of the present invention to provide an automatic machine with an operating wheel, designed to eliminate the aforementioned drawbacks, and which, in particular, is straightforward and cheap to produce.

According to the present invention, there is provided an automatic machine comprising a fixed central control unit; at least one operating wheel rotating about a central axis and supporting a number of work stations; and a communication apparatus for connecting each said work station to said central control unit; the machine being characterized in that said communication apparatus comprises a cordless communication unit having a movable communication device carried by said wheel, and a fixed communication device carried by the machine; said communication devices being substantially coaxial with said central axis so as to substantially face each other at all times as the wheel rotates.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
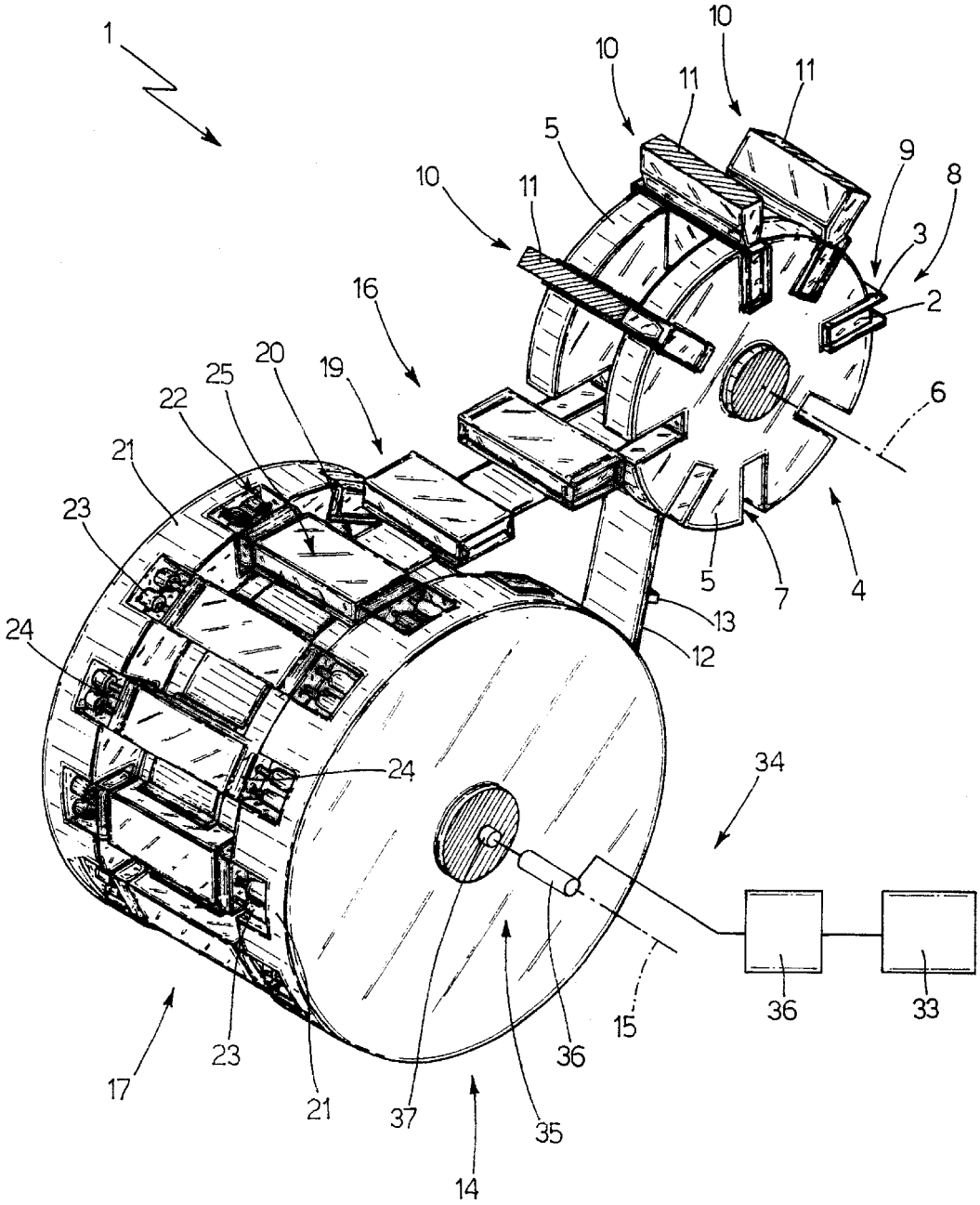
FIG. 1 shows a schematic view in perspective, partly in block form and with parts removed for clarity, of a preferred embodiment of the automatic machine according to the present invention.

Number 1 in FIG. 1 indicates as a whole a cellophaning machine, of the type described in U.S. Pat. No. 5,477,661, for overwrapping packets 2 of cigarettes in sheets 3 of transparent plastic heat-seal wrapping material.

Machine 1 comprises a wrapping wheel 4 defined by two side by side disks 5, and which is mounted to rotate in steps about a horizontal axis 6 and has a number of peripheral conveying pockets 7. When stopped at a loading station 8, each pocket 7 receives a respective sheet 3 of transparent plastic material and a respective packet 2, which are inserted in known manner inside pocket 7 so as to fold sheet 3 into a U about packet 2.

In the course of said stop at loading station 8 and the next forward step away from loading station 8, the ends of the U-folded sheet 3 are folded in known manner one on top of the other to form a tubular wrapping 9, which is stabilized by heat sealing as respective pocket 7 is stopped at three heat-seal stations 10 having respective known heat-seal devices 11.

Each stabilized tubular wrapping 9 is extracted from respective pocket 7 by a belt 12, which has a number of push projections 13 on the outside and is looped about a first end pulley (not shown) located between disks 5 of wheel 4, and about a second end pulley defined by a heat-seal wheel 14 rotating continuously about a horizontal axis 15 parallel to axis 6.

Figure 2:
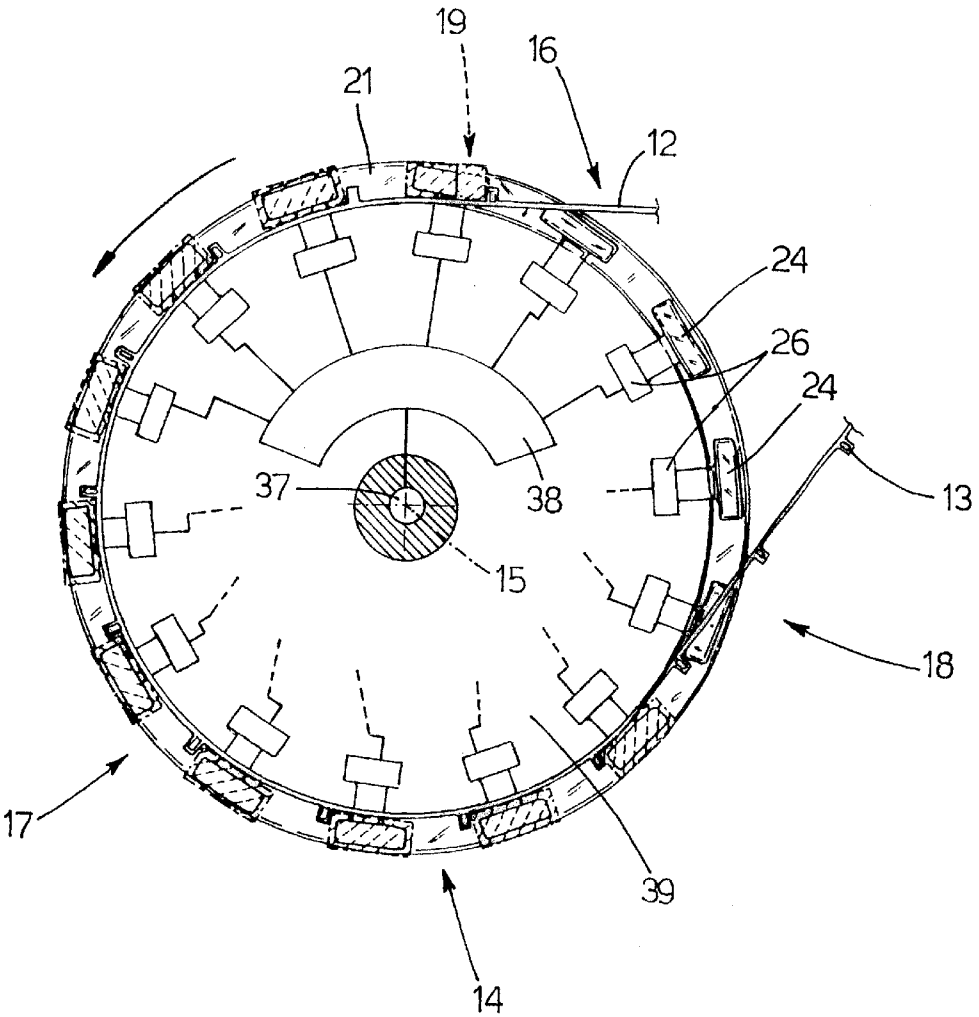
FIG. 2 shows a front view, with parts removed for clarity, of a detail in FIG. 1.

Belt 12 feeds each tubular wrapping 9 along a straight conveying branch 16 between wrapping wheel 4 and heat-seal wheel 14, and along a circular downstream conveying branch 17 extending about heat-seal wheel 14 and terminating at an unloading station 18 (FIG. 2).

At least part of the straight conveying branch 16 defined by belt 12 extends through known fixed helical folding devices (not shown), which fold the opposite open ends of tubular wrappings 9 onto the respective ends of respective packets 2 as tubular wrappings 9 are transferred from wrapping wheel 4 to heat-seal wheel 14, so as to form complete wrappings 19, which are then stabilized at the ends by heat sealing on heat-seal wheel 14.

Heat-seal wheel 14 has a central annular groove 20 housing belt 12 and defining two annular lateral shoulders 21 located on opposite sides of groove 20 and having dead axial recesses 22 aligned with one another. The recesses 22 in each pair of aligned recesses 22 house two opposed actuating devices 23, each of which is interposed between one end of respective recess 22 and a heat-seal head 24 moved by respective actuating device 23 to and from the other heat-seal head 24 to define, on heat-seal wheel 14, a respective heat-seal seat or station 25 for receiving a respective tubular wrapping 9, and the length of which varies from a minimum substantially equal to the length of a packet 2.

Along conveying branch 17, each wrapping 19 is positioned inside a respective station 25 and engaged by respective heat-seal heads 24, which stabilize the ends of wrapping 19 by heat sealing the ends folded previously.

As shown in FIG. 2, each pair of heat-seal heads 24 comprises a respective control unit 26 for controlling the temperature and correct operation of heat-seal heads 24. More specifically, each heat-seal head 24 comprises a respective electric resistor 27 (FIG. 3) supplied by relative control unit 26; and a respective temperature sensor 28 (FIG. 3), in particular a thermocouple, connected to relative control unit 26, which feedback controls the temperature of heat-seal head 24 in known manner.

Figure 3:
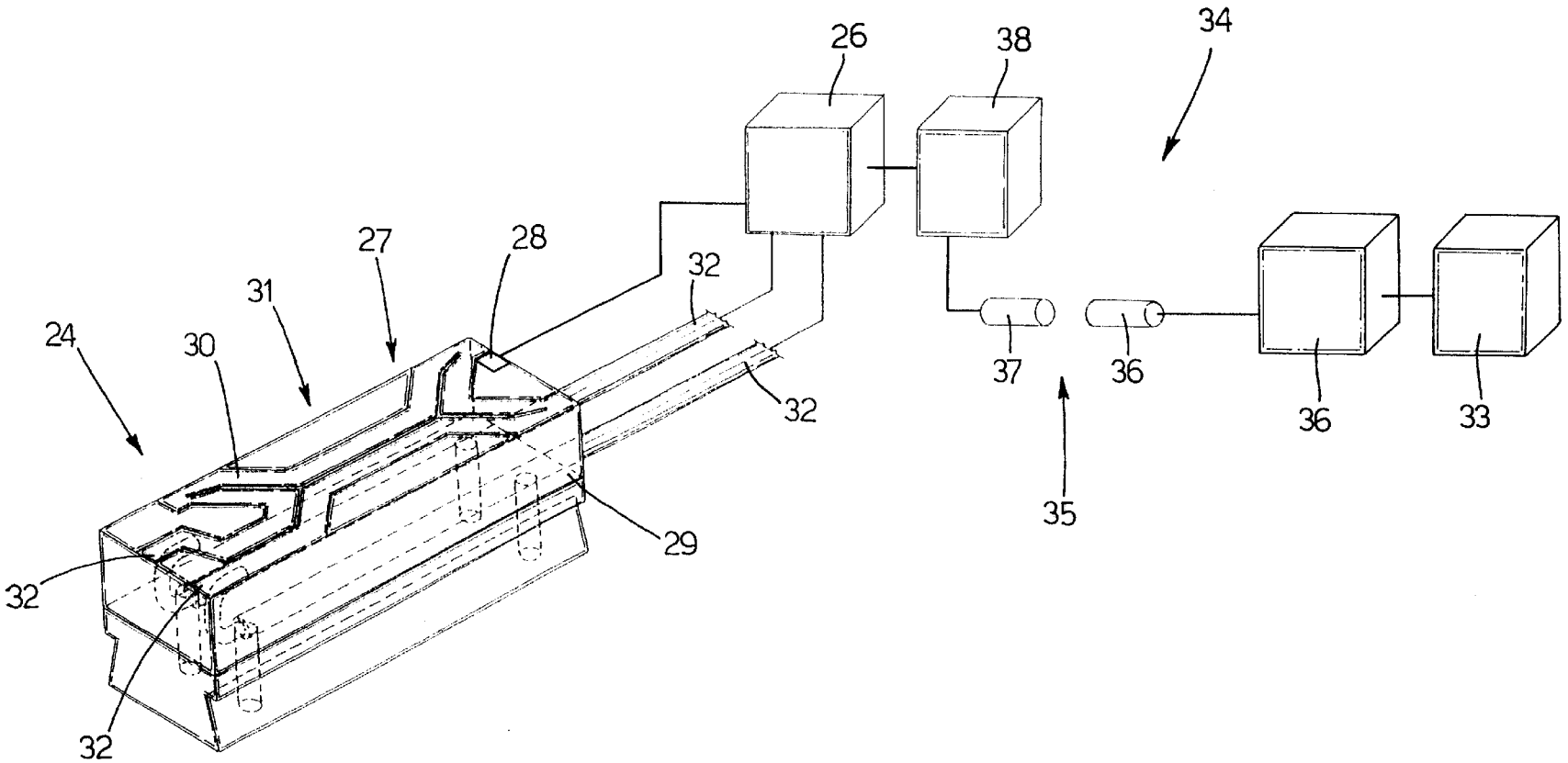
FIG. 3 shows a schematic view in perspective of a further detail in FIG. 1.

As shown in FIG. 3, each heat-seal head 24 comprises a supporting pad 29 made of thermally insulating material (in particular, silicone rubber); and a plate 30 supported by pad 29 and made of electrically and thermally conducting material (in particular, metal). Plate 30 defines both electric resistor 27 and a heat-seal surface, and comprises a strip extending along a work path 31 having two ends 32. Temperature sensor 28 is embedded inside pad 29 so that a measuring surface of sensor 28 contacts plate 30.

Each control unit 26 is connected electrically to ends 32 of a respective plate 30 to feed alternating or direct electric current of adjustable intensity along plate 30 and work path 31, and so establish and maintain a given desired temperature of plate 30.

In an alternative embodiment, each control unit 26 comprises a measuring device for determining the total electric resistance of corresponding plate 30 between ends 32—by measuring the voltage and current between ends 32—as well as for determining the temperature of plate 30 on the basis of said resistance. In such an embodiment, temperature sensors 28 are obviously dispensed with.

As shown in FIGS. 1 and 2, cellophaning machine 1 comprises a fixed central control unit 33 for controlling and regulating machine 1 as a whole; and a communication apparatus 34 for connecting each control unit 26 on heat-seal wheel 14 to central control unit 33.

Via communication apparatus 34, central control unit 33 transmits to control units 26 the optimum temperature value of plates 30, which normally varies as a function of the operating speed of machine 1 and the type of sheets 3 of wrapping material used. Via communication apparatus 34, control units 26 in turn transmit diagnostic messages, in particular fault signals, to central control unit 33.

Communication apparatus 34 comprises a cordless communication unit 35 having a movable communication device 37 carried by heat-seal wheel 14, and a fixed communication device 36 carried in a fixed position by machine 1; and the two communication devices 36 and 37 are so positioned as to be substantially coaxial with central axis 15 of heat-seal wheel 14 and to substantially face each other at all times as heat-seal wheel 14 rotates.

In a preferred embodiment, communication devices 36 and 37 each transmit and receive optical, in particular laser or infrared, electromagnetic waves. More specifically, the infrared waves emitted by one communication device 36 or 37 travel within a conical volume towards the other communication device 37 or 36, so that the other device is covered by the infrared waves even if mounted with a certain amount of eccentricity with respect to central axis 15 of heat-seal wheel 14.

In an alternative embodiment, communication devices 36 and 37 each transmit and receive radio electromagnetic waves; and, in yet a further alternative embodiment, communication devices 36 and 37 comprise inductive or capacitive coupling means.

As shown in FIG. 1 or 2, movable communication device 37 comprises a processing element 38, which groups a series of different output signals, sent by control units 26, into a single group output signal for supply to fixed communication device 36, and divides a single group input signal, received from fixed communication device 36, into a series of different input signals for supply to the corresponding control units 26. In a preferred embodiment, said group signals are organized according to a serial communication protocol.

As shown in FIG. 2, movable communication device 37, processing element 38 and control units 26 are all housed in one circular support 39 fixed to a base surface of heat-seal wheel 14.

As compared with known heat-seal wheels, heat-seal wheel 14 as described above provides for optimum temperature and operation control of heat-seal heads 24, while at the same time being highly compact and low-cost by featuring only two known sliding contacts (not shown) for supplying heat-seal wheel 14 with the electrical power required to operate movable communication device 37 and control units 26 (which in turn supply resistors 27 of heat-seal heads 24).

Moreover, providing each control unit 26 with the logic circuits for controlling the respective pair of heat-seal heads 24 greatly reduces data exchange between control units 26 and central control unit 33, which exchange is substantially limited to diagnostic signals and commands to vary the set temperature value. As such, the amount of data transmitted per unit of time by communication apparatus 34 is relatively small, with definite advantages as regards both transmission dependability and the cost of communication apparatus 34.

In an alternative embodiment not shown, a cordless communication unit such as communication unit 35 described above is applied to an automatic machine other than a cellophaning machine. More specifically, the communication unit may be used in the filter assembly section of a cigarette manufacturing machine, to permit communication between a control drum supporting a number of stations for performing a series of checks of the cigarettes, and a central control unit of the machine.

What is claimed is:

1. An automatic machine comprising a fixed central control unit (33); at least one operating wheel (14) rotating about a central axis (15) and supporting a number of work stations (25); and a communication apparatus (34) for connecting each said work station (25) to said central control unit (33); the machine being characterized in that said communication apparatus (34) comprises a cordless communication unit (35) having a movable communication device (37) carried by said wheel (14), and a fixed communication device (36) carried by the machine (1); said communication devices (36, 37) being substantially coaxial with said central axis (15) so as to substantially face each other at all times as the wheel rotates (14).

2. A machine as claimed in claim 1, characterized in that each said work station (25) comprises a respective local control unit (26) for receiving regulating signals from said central control unit (33), and for transmitting diagnostic signals to the central control unit (33).

3. A machine as claimed in claim 2, characterized in that each said local control unit (26) and said movable communication device (37) are carried by a single circular support (39) in turn carried by said wheel (14).

4. A machine as claimed in claim 1, characterized in that said movable communication device (37) comprises processing means (38), which group a series of different output signals, sent by said work stations (25), into a single group output signal for supply to said fixed communication device (36), and divide a single group input signal, received from the fixed communication device (36), into a series of different input signals for supply to the corresponding work stations (25).

5. A machine as claimed in claim 4, characterized in that said processing means (38) process said group signals by means of a serial communication protocol.

6. A machine as claimed in claim 1, characterized in that said cordless communication devices (36, 37) comprise transmitting and receiving means for transmitting and receiving electromagnetic waves.

7. A machine as claimed in claim 6, characterized in that said electromagnetic waves emitted by one said communication device (36;37) travel within a conical volume towards the other communication device (37;36).

8. A machine as claimed in claim 6, characterized in that said transmitting and receiving means transmit and receive optical laser or infrared, electromagnetic waves.

9. A machine as claimed in claim 6, characterized in that said transmitting and receiving means transmit and receive radio electromagnetic waves.

10. A machine as claimed in claim 6, characterized in that said transmitting and receiving means comprise inductive or capacitive coupling means.

11. A machine as claimed in claim 1 and for overwrapping packets (2) of cigarettes; said wheel (14) being a heat-seal wheel, and said work stations (25) being heat-seal stations.

12. A machine as claimed in claim 1 and for manufacturing cigarettes; said wheel being a control wheel, and said work stations being cigarette control stations.

* * * * *

UNITED STATES PATENT AND TRADEMARK OFFICE

CERTIFICATE OF CORRECTION

PATENT NO. : 6,487,831 B1 
DATED : December 3, 2002
INVENTOR(S) : Mario Turra et al.

It is certified that error appears in the above-identified patent and that said Letters Patent is hereby corrected as shown below:

Title page,
Item [*], "117" should read -- 120 --.

Signed and Sealed this

Fifteenth Day of April, 2003

JAMES E. ROGAN
*Director of the United States Patent and Trademark Office*